US008308429B2

(12) United States Patent
Walker

(10) Patent No.: US 8,308,429 B2
(45) Date of Patent: Nov. 13, 2012

(54) AXIAL COMPRESSOR

(75) Inventor: Mark O. Walker, Derby (GB)

(73) Assignee: Rolls-Royce, PLC, London (GB)

( * ) Notice: Subject to any disclaimer, the term of this patent is extended or adjusted under 35 U.S.C. 154(b) by 504 days.

(21) Appl. No.: 12/693,103

(22) Filed: Jan. 25, 2010

(65) Prior Publication Data

US 2010/0196143 A1 Aug. 5, 2010

(30) Foreign Application Priority Data

Jan. 30, 2009 (GB) ..... 0901473.9

(51) Int. Cl.
*F04D 29/32* (2006.01)

(52) U.S. Cl. ..... 415/144; 415/168.1; 415/168.4; 415/914

(58) Field of Classification Search ..... 415/144, 415/168.1, 168.2, 168.4, 173.7, 229, 914
See application file for complete search history.

(56) References Cited

U.S. PATENT DOCUMENTS 3,746,462 A * 7/1973 Fukuda ..... 415/115
4,146,352 A * 3/1979 Yasugahira et al. ..... 415/144
4,165,949 A * 8/1979 Riollet ..... 415/77
5,167,486 A * 12/1992 Detanne ..... 415/115
2007/0297897 A1 12/2007 Tran et al.
2008/0310961 A1* 12/2008 Guemmer ..... 416/189
2009/0047120 A1* 2/2009 Guemmer ..... 415/110

FOREIGN PATENT DOCUMENTS

DE 35 23 469 A1 1/1987
EP 1 052 376 A3 11/2000
GB 2110767 A 6/1983
GB 2 422 641 A 8/2006
GB 2 449 249 A 11/2008

OTHER PUBLICATIONS

May 13, 2009 Search Report issued in British Patent Application No. 0901473.9.

* cited by examiner

*Primary Examiner* — Edward Look
*Assistant Examiner* — Liam McDowell
(74) *Attorney, Agent, or Firm* — Oliff & Berridge, PLC

(57) ABSTRACT

An axial compressor comprises a stator component and a rotor component, which cooperate to perform work on a fluid flow in a primary flow-passage defined by the stator and rotor components, the stator component and the rotor component further defining a secondary flow-passage which interconnects a higher pressure region and a lower pressure region of the primary flow-passage, the rotor component being provided with at least one secondary rotor element which, in normal operation of the machine, pumps a bypass flow of fluid through the secondary flow passage from the lower pressure region to the higher pressure region.

16 Claims, 5 Drawing Sheets

AXIAL COMPRESSOR

The present invention relates generally to axial-flow turbo machinery, and particularly to an axial compressor in a gas turbine engine.

Axial compressors in gas turbine engines comprise alternating rows of rotatable blades and stationary blades (or "vanes") in axial flow series with one another. The rows are normally arranged in pairs to form stages, with each stage comprising a rotatable blade row followed by a stationary blade row.

In a common configuration, the rotatable blades are carried on an axial rotor support structure centred on the axis of the turbo machine, and the stationary blades extend inwardly towards the rotor support structure from a surrounding static outer casing structure of the turbo machine.

During operation, an axial primary flow of compressible fluid passes successively through the rows of rotatable blades and stationary blades, and the blades interact with this flow so that each stage acts to provide an incremental increase in the pressure of the fluid, The static pressure in the primary flow increases axially across each row of stationary blades.

The resulting static pressure differential across a stationary blade row tends to drive a leakage flow between the stationary blades and the rotor support structure, i.e. underneath the stationary blades. This leakage flow can enter the main flow annulus on the low pressure side of the stationary blade row, leading to significant aerodynamic losses.

Efforts to reduce the leakage flow underneath the stationary blades have focused on the use of shrouded rows of stationary blades in conjunction with a rotary seal, such as a labyrinth seal or brush seal, provided between the rotor support structure and the respective shroud ring. Whilst these conventional sealing methods can be relatively effective, it is found that some pressure-driven leakage does inevitably still occur across the seal. The problem of leakage can also be exacerbated over time by increases in the running clearance of the seal caused by seal abrasion and wear.

According to the present invention there is provided an axial flow turbo machine as set out in the claims.

Embodiments of the invention will now be described in more detail, by way of example, with reference to the accompanying drawings, in which.

Figure 3A:
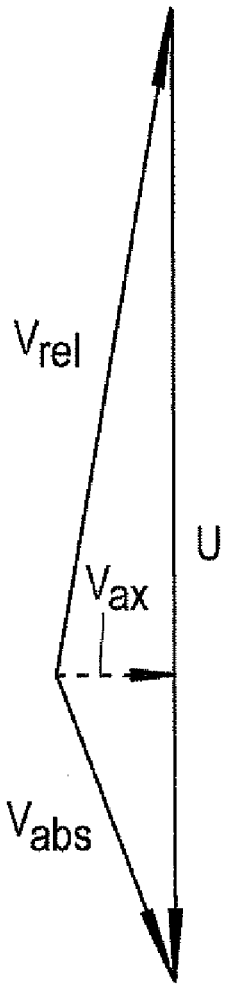
Figure 3B:
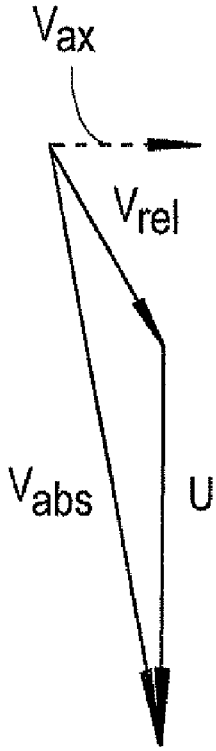
Figure 4:
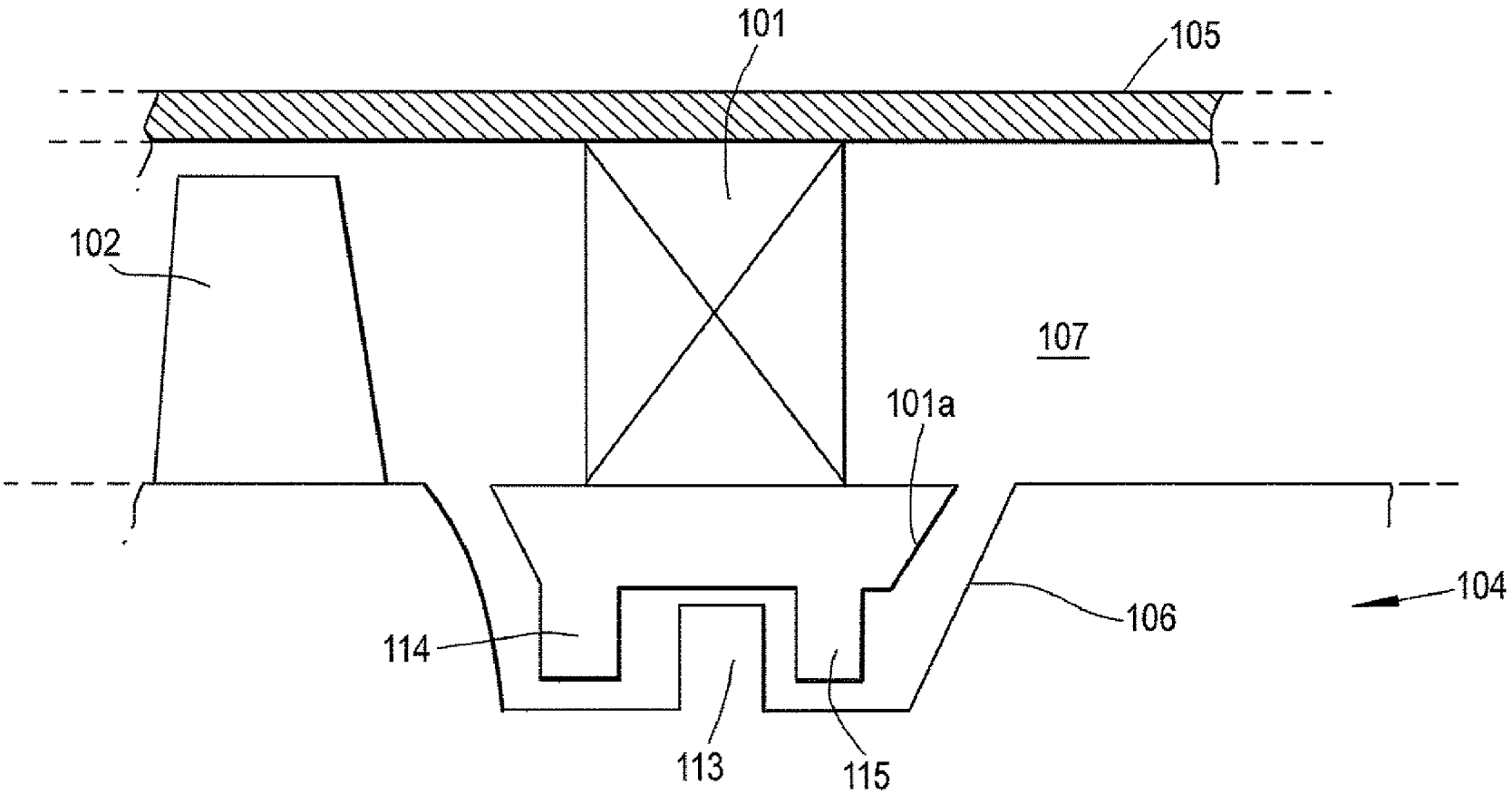
Figure 5:
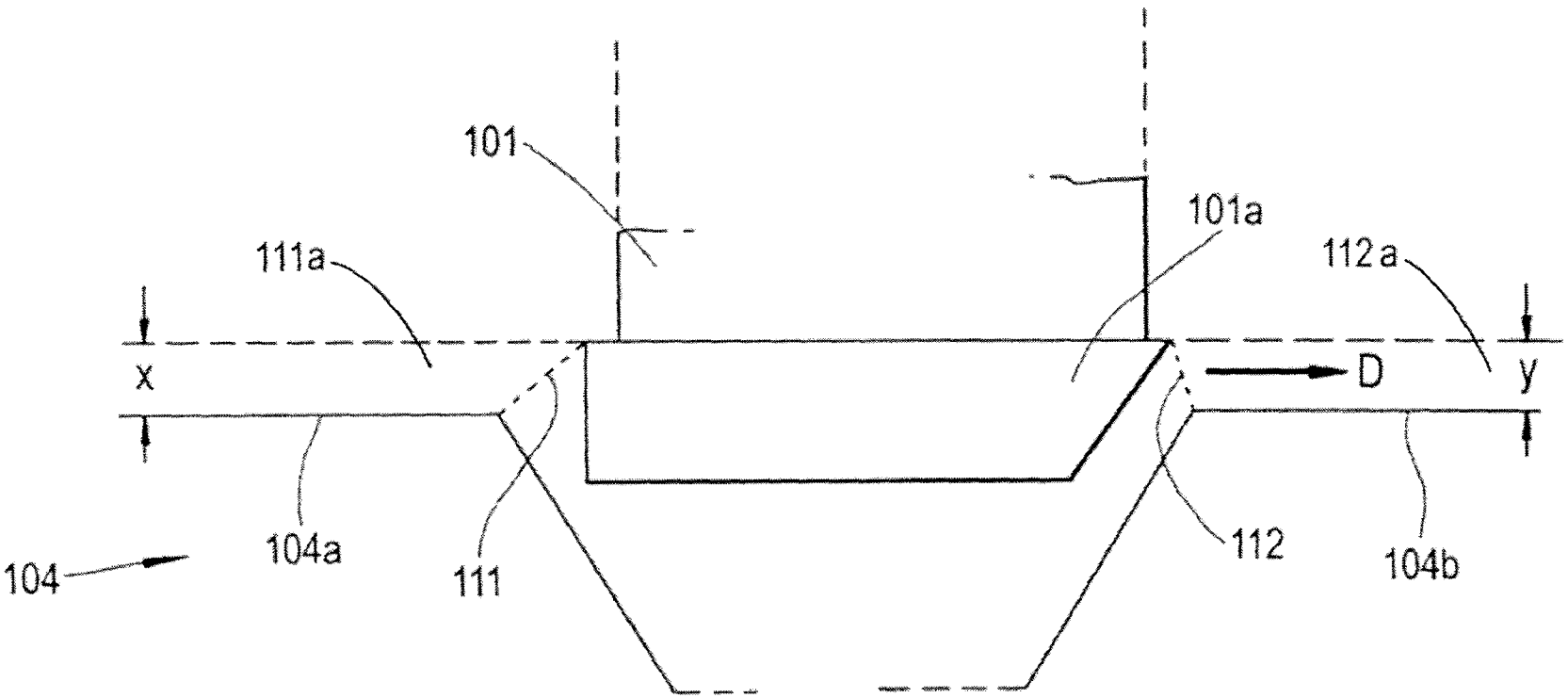

FIGS. 3*a* and 3*b* are vector diagrams illustrating the absolute and relative velocity of a bypass flow relative to a secondary rotor element in accordance with an aspect of the present invention;

FIG. 4 is a simplified cross-sectional view showing part of an axial flow turbo machine according to a further embodiment of the present invention;

FIG. 5 is a simplified cross-sectional view highlighting part of an axial flow turbo machine according to a yet further embodiment of the present invention.

Figure 1:
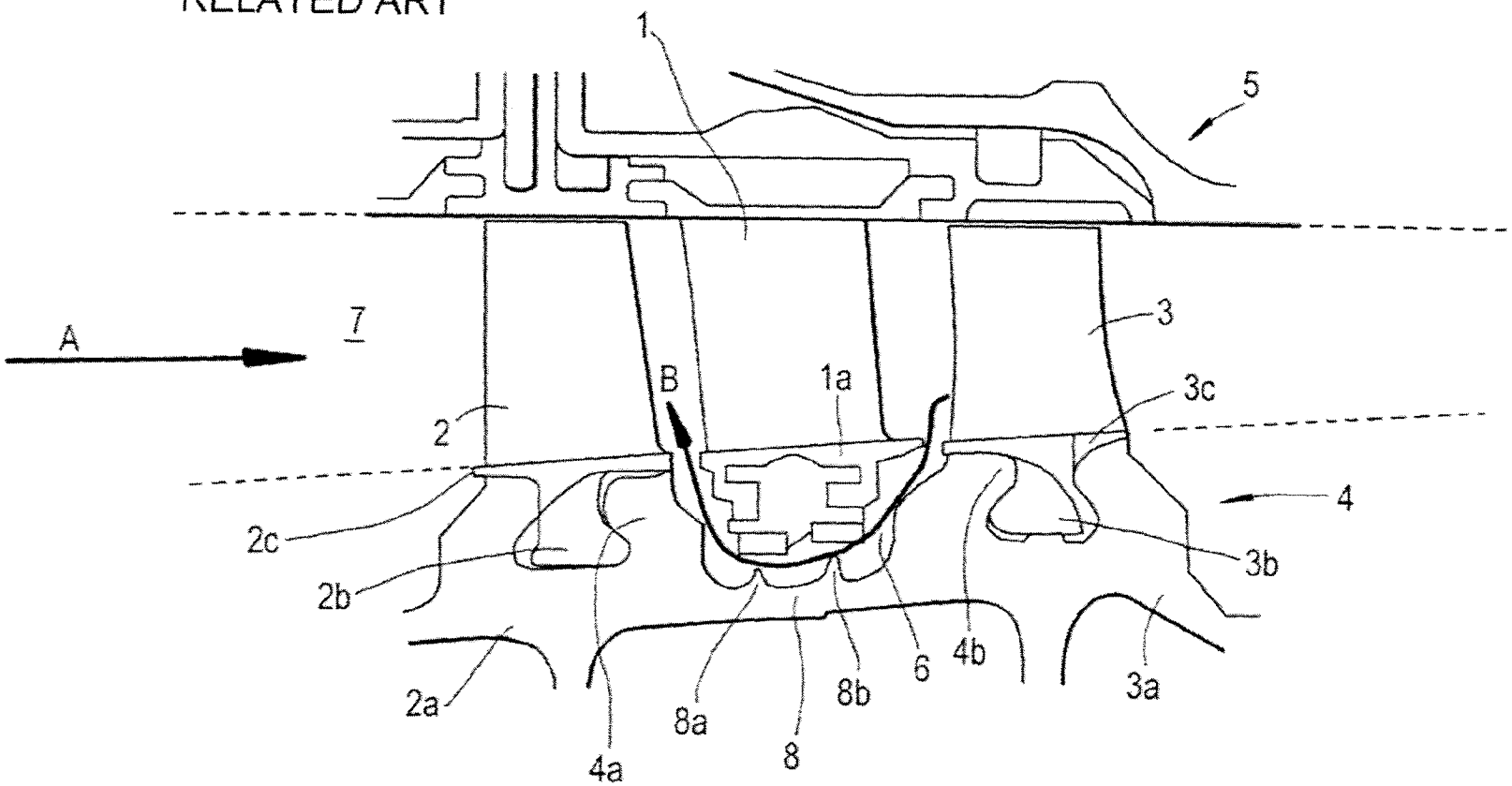
Fig.1 RELATED ART
FIG. 1 is a cross-sectional view showing part of a conventional gas turbine compressor.

FIG. 1 illustrates one example of a conventional geometry for a gas turbine compressor. A single, annular stationary blade row in the form of a shrouded stator vane array 1 is shown in axial flow series between an upstream row of rotor blades 2 and a downstream row of rotor blades 3. The upstream rotor row 2 and the stator vane array 1 together form a compressor stage; the compressor will generally comprise a plurality of such stages: for example the downstream rotor 3 will form a further pressure stage with a corresponding downstream array of stator vanes (not shown).

The rotor rows 2, 3 form part of a rotatable assembly 4. The rotatable assembly 4 comprises respective compressor discs 2*a*, 3*a* which are mounted on one of the main rotor shafts (not shown) extending along the centerline of the gas turbine. Each blade in the rotor row 2, 3 is secured to the respective compressor disc 2*a*, 3*a* via a root-fixing 2*b*, 3*b*—commonly of fir-tree design—and incorporates a corresponding blade platform 2*c*, 3*c*.

The stator array 1 is fixedly secured to a static outer casing structure 5 and the respective stator shroud 1*a* is received in a recess 6 extending underneath the stator array 1 between hub-sections 4*a*, 4*b* of the rotatable assembly 4 to form a shroud cavity.

The blade platforms 2*c*, 3*c* and the shroud 1*a* together form part of an axially-segmented wall of a respective annular flow passage 7 through the compressor (the axially segmented wall will generally also comprise corresponding stator shrouds and blade platforms in respective upstream and downstream compressor stages).

In operation a primary, compressible flow passes through the flow passage 7 in the direction A and a static pressure increase is introduced axially across the stator vane in the direction of the primary flow. The static pressure differential tends to drive a leakage flow B back through the shroud cavity (via the circumferential slot between the blade platform 3*c* and the shroud 1*a*) and into the flow passage 7 on the low pressure side of the stator array 1 (via the circumferential slot between the blade platform 2*c* and the shroud 1*a*).

A conventional labyrinth seal 8, comprising sealing fins 8*a*, 8*b*, is provided between the rotatable assembly 4 and the shroud 1*a* to create a physical resistance to air flow and therefore reduce the leakage flow B as far as possible. The specific geometry of the labyrinth seal 8 will typically be designed to encourage a degree of flow re-circulation for reducing the driving static pressure differential across the stator vane.

Figure 2:
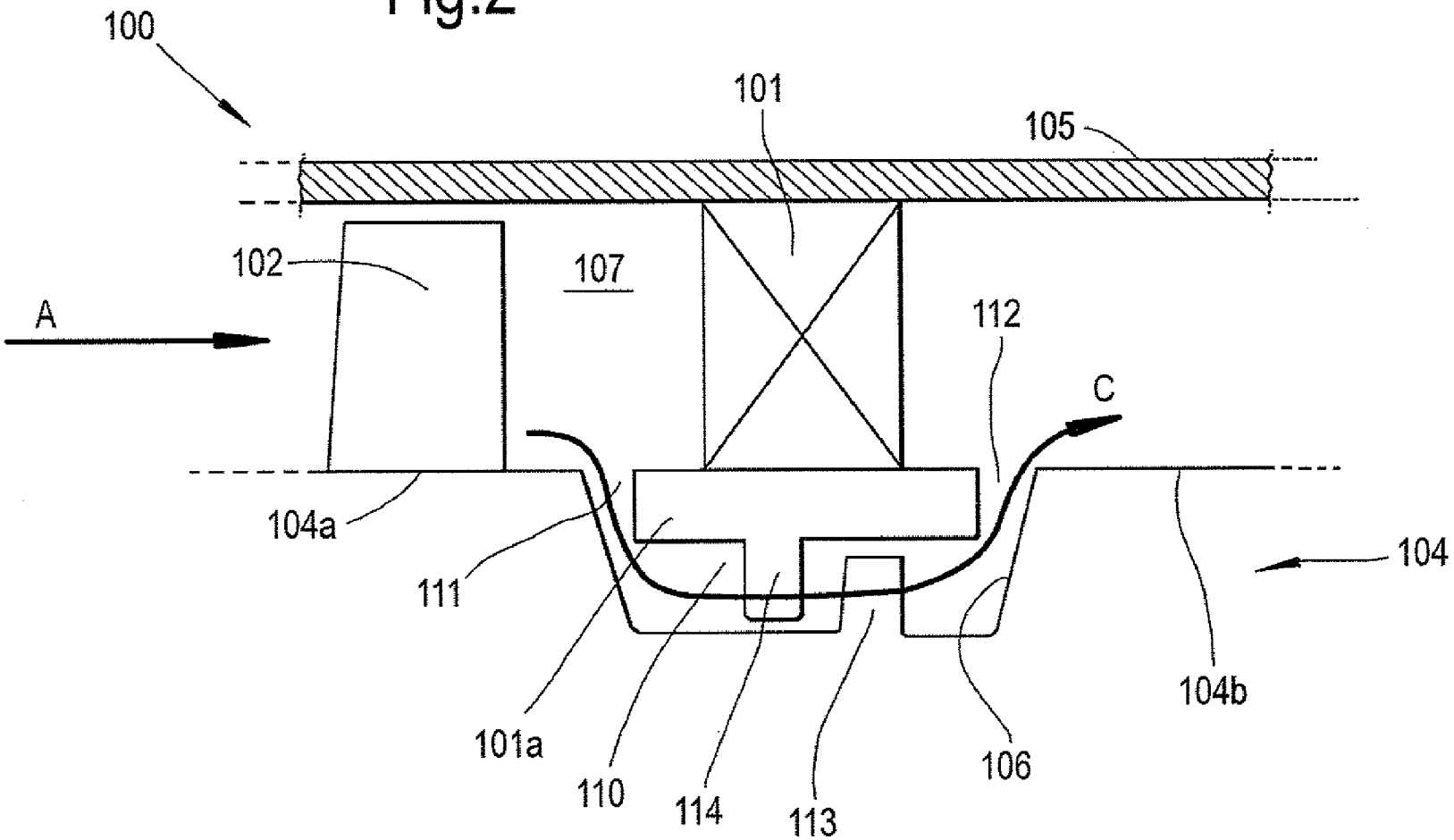
FIG. 2 is a simplified cross-sectional view showing part of a an axial flow turbo machine according to the present invention.

FIG. 2 is a view of a part of a compressor 100 according to the present invention.

The geometry of the compressor 100 has been greatly simplified in FIG. 2 for clarity; in practice however the precise in-service geometry may vary according to the specific application: for example, the geometry may be similar to the arrangement shown in FIG. 1.

Briefly, the compressor 100 comprises an annular, shrouded row of stationary blades 101 forming part of a larger casing structure 105, and an upstream row of rotatable blades 102 forming part of a larger rotatable assembly 104 extending axially through the stationary blade row 101. The respective shroud 101*a* is located inside a recess 106 extending axially underneath the stationary blades 101 to form a shroud cavity 110. The recess 106 extends between a first hub section 104*a* of the rotatable assembly 104 (which may be the blade platform 2*c*, for example—see FIG. 1) and a second hub section 104*b* of the rotatable assembly 104 (which may the blade platform 3*c*, for example—see FIG. 1) and provides a running clearance between the stationary blades 101 and the rotatable assembly 104.

The shroud 101*a* and hub sections 104*a*, 104*b* together form part of an axially-segmented wall of an annular flow passage 107, with the shroud cavity 110 consequently having a circumferential intake 111 slot between the shroud 101*a* and the hub-section 104*a*, and a circumferential discharge slot 112 between the shroud 101*a* and the hub-section 104*b*.

The casing structure 105 (which may be considered to be a stator component) and the rotatable assembly 104 (which may be considered to be a rotor component) thus together form a first flow passage, being the flow passage 107, and a second flow passage, being the running clearance between the stationary blades 101 and the rotatable assembly 104.

Inside the shroud cavity 110, the rotor assembly 104 further incorporates a row of secondary rotor elements 113. Although only one element 113 is shown in FIG. 2, it will be appreciated that the elements 113 form an annular array extending all around the circumference of the shroud cavity 110.

In operation the primary flow will pass through the flow passage 107 in the direction A in FIG. 2, similar to the arrangement shown in FIG. 1, and an increase in the static pressure of the primary flow will occur axially across the stator array 101 in the direction of the flow.

To ensure clarity, it will be understood by the skilled reader that in the normal operation of an axial compressor the static pressure will be greater on the pressure surface of an individual stationary blade than on its suction surface. Also, the operation of the compressor as a whole will cause the static pressure at the axially downstream (trailing edge) end of the stationary blade row to be higher than at the axially upstream (leading edge) end of the row. When references are made within this specification to "higher pressure side" or the like, it should be understood that the latter meaning is intended, referring to differences of static pressure between upstream and downstream ends of the entire blade row and not to any pressure differences that might arise across individual blades.

The rotor elements 113 are configured such that as they co-rotate with the rotor assembly 104 they act to pump a bypass flow C through the shroud cavity 110, from the low (static) pressure side of the stator row 101 towards the high (static) pressure side of the stator row 101.

It will be appreciated that the bypass flow C is in the opposite axial direction to the leakage flow B in FIG. 1. In the arrangement in FIG. 2 fluid is thus actively driven through the shroud cavity 110 in a manner reinforcing the static pressure differential across the stator row 101, in contrast to the arrangement in FIG. 1 where a pressure-driven leakage flow B (tending to reduce the static pressure differential across stator row 1) is limited as far as possible by the essentially passive labyrinth seal 8.

The rotor elements 113 may take any suitable form for driving the bypass flow C axially through the shroud cavity 110: for example they may be suitable aerofoil blades. The total pressure of the flow through the secondary flow path will be raised as it passes through the rotor elements 113.

The velocity of the bypass flow C incident on the rotor elements 113 will depend in part on the geometry inside the shroud cavity 110, and the axial component of this bypass velocity will generally be significantly slower than the axial component of the primary flow velocity in the flow passage 107. In addition, the rotor elements 113 will exhibit a reduced tangential velocity compared to the rotor blades 102 due to their relative radii of rotation (and equal angular speed). One or both of these factors may result in "flow mis-matching" between the rotor blades 102 and the rotor elements 113.

This is illustrated in the velocity triangle shown in FIG. 3*a* where $V_{abs}$ is the absolute velocity of the bypass flow C incident on a rotor element 113, U is the tangential velocity of the rotor element 113 (fixed by the rotational speed of the rotating assembly 104) and $V_{rel}$ is the resultant velocity of the bypass flow relative to the rotor element 113. Here, the low axial component $V_{ax}$ of the bypass velocity leads to a high incidence of bypass flow C onto the rotor element 113. The problem may be exacerbated by the relatively low tangential velocity of the rotor element 113 compared to the rotor row 102; in the extreme case shown in FIG. 3*b*, the tangential velocity U of the rotor element 113 is smaller in magnitude than the tangential component of the absolute velocity $V_{abs}$ of the bypass flow, leading to a "negative" incident velocity $V_{rel}$.

Where flow mis-matching may occur, one or more secondary flow-turning stator elements 114 can be provided inside the shroud cavity 110 in axial flow series with the secondary rotor elements 113, for increasing the axial velocity of the bypass flow C as appropriate.

One or more stator elements may additionally or alternatively be provided inside the shroud cavity 110 downstream of the rotor elements 113 for removing swirl from the bypass flow C, for example where there is no rotor downstream of the shroud cavity 110 in the main flow passage 107. A stator element 115 is shown in FIG. 4, provided between the rotor elements 113 and the discharge slot 112.

The stator elements 114, 115 are conveniently supported on the underside of the shroud 101*a*.

The shroud 101*a* and the rotor assembly 104 may in general be configured for co-operatively guiding bypass flow down into the shroud cavity 110 through the intake slot and/or for co-operatively 'vectoring' the bypass flow exiting through the discharge slot, in particular to increase the axial momentum of bypass flow exiting the discharge slot. By way of example, one or both of the shroud 101*a* and recess 106 may be banked, as shown respectively in FIGS. 2 and 4.

The intake slot formed between the shroud 101*a* and the hub section 102*a* may be an annular slot 111*a* as illustrated in FIG. 5 (cf. FIGS. 2 and 4, where the slot 111 is not annular), for substantially axial aspiration of a nominal primary flow boundary layer thickness x on the first hub section 104*a* corresponding to the annular slot width x of the slot 111*a* (see FIG. 5).

It is envisaged that active aspiration of the low-momentum primary flow boundary layer through an annular intake slot will reduce aerodynamic losses at the stator 101 in the main turbo flow passage 107.

It is of course appreciated that the thickness and energy of the boundary layer will change with the operating conditions of the gas turbine engine (specifically, with variations in compressor aerodynamic speed and with any transient excursions away from the nominal working line). Therefore, the intake slot will be designed to ensure the most complete ingestion of the boundary layer for all operating conditions. This "bleeding off" of a substantial part of the boundary layer upstream of the stationary blade row is expected to provide significant aerodynamic advantages. The platforms of the upstream rotating blades may also be designed to assist the efficient bleeding off of the boundary layer.

Additionally or alternatively, the discharge slot formed between the shroud 101*a* and the hub section 103*a* may be an annular discharge slot 112*a*, again as shown in FIG. 5 (in this case in conjunction with a shroud 101*a* which is banked near the discharge slot 112), allowing discharge of a suitably vectored bypass flow D substantially axially along the hub section 103*a* for energising a nominal primary flow boundary layer thickness y on the second hub section 104*b*, corresponding to the annular slot width y of the slot 112*a*. It is envisaged that energising the primary flow boundary layer on the second hub section 104*b* may reduce boundary layer effects along the hub section 104*b*.

Use of an annular discharge slot may be particularly advantageous for energising the primary flow boundary layer y upstream of a successive row of rotor blades in the main flow passage 107, where it is envisaged that corresponding aerodynamic losses at the hub region of the rotor blades may be reduced.

The comments above concerning the variation in boundary layer thickness and energy with operating conditions apply equally to the discharge slot, and this will also be designed to provide the most advantageous discharge of the bypass flow over all operating conditions of the engine. As before, the platforms of the downstream rotating blades may also be designed to assist the efficient discharge of the bypass flow.

More than one row of rotor elements 113 may be provided in the shroud cavity 110, optionally in conjunction with a respective number of rows of stator elements 114, 115. The rotor elements may be provided on any wall of the recess 106, including on banked walls of the recess 106.

The invention is considered to be particularly suitable for use in industrial and marine gas turbines, where additional engine weight can typically be accommodated in the overall engine design, but may also be used in aero engines provided that implementation is carried out within corresponding weight constraints on engine design.

The invention claimed is:

1. An axial compressor comprising a stator component and a rotor component which cooperate to perform work on a fluid flow in a primary flow-passage defined by the stator and rotor components, the stator component and the rotor component further defining a secondary flow-passage which interconnects a higher pressure region and a lower pressure region of the primary flow-passage, the rotor component being provided with at least one secondary rotor element which, in normal operation of the machine, pumps a bypass flow of fluid through the secondary flow passage from the lower pressure region to the higher pressure region.

2. The axial compressor according to claim 1 in which the rotor component and the stator component provide a primary flow stage comprising an annular row of rotatable blades and an annular row of stationary blades in axial flow series with the rotatable blades for introducing a static pressure differential in a flow passage constituting the primary flow-passage, the rotatable blade row forming part of a rotatable assembly which extends axially through the annular stationary blade row and which is separated from the stationary blades by a running clearance constituting the secondary flow-passage, the or each secondary rotor element being provided on the rotatable assembly for driving a bypass flow generally axially through the running clearance, towards the nominal high pressure side of the stationary blade row, thereby to limit pressure-driven leakage underneath the stationary blades.

3. The axial compressor according to claim 2, wherein the running clearance is provided by a recess between spaced apart hub sections of the rotor assembly that form part of an axially-segmented inner wall of the flow passage, the recess extending axially underneath the stationary blades from the nominal low pressure side of the stationary blade row to the nominal high pressure side of the stationary blade row.

4. The axial compressor according to claim 3, wherein the secondary rotor elements are located in the recess for drawing said bypass flow into the recess on the nominal low pressure side of the stationary blade row and driving the bypass flow out of the recess on the nominal high pressure side of the stationary blade row.

5. The axial compressor according to claim 3, wherein the stationary blades are radially shielded from the bypass flow in the recess by a shroud at or near the inner end of the stationary blades, the shroud and recess forming a shroud cavity having a circumferential intake slot between the shroud and the first hub section, and a circumferential discharge slot between the shroud and the second hub section.

6. The axial compressor according to claim 5, wherein the shroud supports one or more stator elements inside the shroud cavity in axial flow series with the secondary rotor elements inside the shroud cavity.

7. The axial flow turbo machine according to claim 6, wherein the shroud supports one or more stator elements between the secondary rotor elements and the intake slot for turning the bypass flow onto the rotor elements.

8. The axial compressor according to claim 6, wherein the shroud supports one or more stator elements between the secondary rotor elements and the discharge slot for removing swirl from the bypass flow.

9. The axial compressor according to claim 5, wherein the shroud forms an annular intake slot with the first hub section for receiving an axial intake flow.

10. The axial compressor according to claim 9, wherein the annular width of the intake slot corresponds to the nominal thickness of a primary flow boundary layer on the first hub section.

11. The axial compressor according to claim 9, wherein the shroud and/or rotor assembly are configured for co-operatively guiding bypass flow through the intake slot and down into the shroud cavity.

12. The axial compressor according to claim 11, wherein the shroud is banked near the intake slot for guiding bypass flow entering the intake slot down into the shroud cavity.

13. The axial compressor according to claim 5, wherein the shroud and the rotor assembly are configured for co-operatively vectoring bypass flow through the discharge slot thereby to increase the axial momentum of by pass flow exiting the discharge slot.

14. The axial compressor according to claim 13, wherein the shroud is banked near the discharge slot for turning the bypass flow axially through the discharge slot thereby to increase the axial momentum of the bypass flow exiting the discharge slot.

15. The axial compressor according to claim 14, wherein the shroud forms an annular discharge slot with the second hub section for discharging a substantially axial bypass flow.

16. The axial compressor according to claim 15, wherein the annular width of the discharge slot corresponds to the nominal thickness of the primary flow boundary layer on the second hub section for increasing the axial momentum of the boundary layer.

* * * * *